US008708049B2

(12) United States Patent
Lawrence et al.

(10) Patent No.: US 8,708,049 B2
(45) Date of Patent: Apr. 29, 2014

(54) DOWNHOLE MIXING DEVICE FOR MIXING A FIRST FLUID WITH A SECOND FLUID

(75) Inventors: Jimmy Lawrence, Amherst, MA (US); Douglas Grant, Cedar Creek, TX (US); Jane T. Lam, Randolph, MA (US); James Haug, Littleton, MA (US); Roman Kats, Brookline, MA (US); Christopher Harrison, Auburndale, MA (US); Andreas Hausot, Tokyo (JP); Michael O'Keefe, London (GB); Oliver C. Mullins, Ridgefield, CT (US); Ronald van Hal, Watertown, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 320 days.

(21) Appl. No.: 13/097,346

(22) Filed: Apr. 29, 2011

(65) Prior Publication Data

US 2012/0273203 A1 Nov. 1, 2012

(51) Int. Cl.

| | |
|---|---|
| ***E21B 49/00*** | (2006.01) |
| ***E21B 34/00*** | (2006.01) |
| ***B01F 7/00*** | (2006.01) |

(52) U.S. Cl.

USPC ..... 166/305.1; 166/100; 166/250.17; 166/373; 175/59; 366/333

(58) Field of Classification Search

USPC ..... 166/305.1, 250.17, 373, 100, 69; 175/50, 59, 58; 222/145.1, 145.5, 222/145.4, 145.7, 145.8, 135; 366/176.3, 366/176.4, 332, 333

See application file for complete search history.

(56) References Cited

U.S. PATENT DOCUMENTS

| | | | | | |
|---|---|---|---|---|---|
| 3,174,547 | A | * | 3/1965 | Fields | 175/4 |
| 3,212,576 | A | * | 10/1965 | Lanmon, II | 166/286 |
| 3,329,204 | A | * | 7/1967 | Brieger | 166/286 |
| 3,347,314 | A | * | 10/1967 | Schuster | 166/286 |
| 3,347,315 | A | * | 10/1967 | Lanmon, II | 166/286 |

(Continued)

FOREIGN PATENT DOCUMENTS

| | | |
|---|---|---|
| EP | 2021769 | 2/2009 |
| WO | 20070143474 | 12/2007 |

OTHER PUBLICATIONS

International Search Report and Written Opinion of PCT Application No. PCT/US2011/049173 dated Apr. 12, 2012: pp. 1-9.

(Continued)

*Primary Examiner* — Jennifer H Gay

(74) *Attorney, Agent, or Firm* — Jakub M. Michna; Bridget Laffey

(57) ABSTRACT

Methods and devices for mixing a first fluid with a second fluid downhole include a chamber having a first end, a second end and an opening for fluid to flow there through. A top surface of a perforated piston is capable of contacting the second end and a top surface of a piston is capable of contacting a bottom surface of the perforated piston. The perforated piston is located at a first position within the chamber based upon characteristics of a first fluid. A first fluid delivery system supplies the first fluid and a second fluid delivery system supplies a second fluid to the chamber, wherein the second fluid is at a pressure that moves the piston approximate to the first end. An actuating device applies a force against the bottom surface of the piston to inject the fluids through channels of the perforated piston to produce spray droplets.

48 Claims, 10 Drawing Sheets

(56) References Cited

U.S. PATENT DOCUMENTS

| | | | | |
|---|---|---|---|---|
| 3,347,322 | A * | 10/1967 | Lanmon, II | 175/4.52 |
| 3,394,767 | A * | 7/1968 | Terry | 175/4.52 |
| 3,507,340 | A * | 4/1970 | Voetter | 175/4.52 |
| 3,731,876 | A | 5/1973 | Showalter | |
| 3,859,851 | A | 1/1975 | Urbanosky | |
| 4,353,508 | A | 10/1982 | Butterfield et al. | |
| 4,860,581 | A | 8/1989 | Zimmerman et al. | |
| 4,923,121 | A | 5/1990 | Boyer | |
| 4,994,671 | A | 2/1991 | Safinya et al. | |
| 5,104,527 | A | 4/1992 | Clinkenbeard | |
| 5,266,800 | A | 11/1993 | Mullins | |
| 5,273,190 | A * | 12/1993 | Lund | 222/83 |
| 5,337,822 | A | 8/1994 | Massie et al. | |
| 5,939,717 | A | 8/1999 | Mullins | |
| 6,027,043 | A | 2/2000 | Rosenberg | |
| 6,402,364 | B1 * | 6/2002 | Esclar et al. | 366/160.4 |
| 6,612,295 | B2 | 9/2003 | Lerner | |
| 6,719,729 | B2 * | 4/2004 | Sogaro | 604/191 |
| 6,995,360 | B2 | 2/2006 | Jones et al. | |
| 7,025,138 | B2 | 4/2006 | Kurkjian et al. | |
| 7,118,349 | B2 * | 10/2006 | Oglesby | 417/53 |
| 7,511,819 | B2 | 3/2009 | DiFoggio | |
| 7,516,654 | B2 | 4/2009 | DiFoggio | |
| 7,523,648 | B2 | 4/2009 | Zougari | |
| 7,614,294 | B2 | 11/2009 | Hegeman et al. | |
| 7,814,782 | B2 | 10/2010 | DiFoggio | |
| 7,937,223 | B2 | 5/2011 | Ciglenec et al. | |
| 7,959,864 | B2 | 6/2011 | Jiang et al. | |
| 8,032,303 | B2 | 10/2011 | Fujisawa et al. | |
| 8,039,791 | B2 | 10/2011 | Dong et al. | |
| 8,056,408 | B2 | 11/2011 | Pop et al. | |
| 8,058,071 | B2 | 11/2011 | Jiang et al. | |
| 8,068,226 | B2 | 11/2011 | Csutak | |
| 8,082,780 | B2 | 12/2011 | Vannuffelen et al. | |
| 8,165,817 | B2 | 4/2012 | Betancourt et al. | |
| 8,379,207 | B2 | 2/2013 | Difoggio et al. | |
| 8,518,702 | B2 | 8/2013 | Jiang et al. | |
| 2002/0087122 | A1 * | 7/2002 | Sogaro | 604/191 |
| 2003/0134426 | A1 | 7/2003 | Jiang et al. | |
| 2005/0056313 | A1 | 3/2005 | Hagen et al. | |
| 2008/0041593 | A1 | 2/2008 | Brown et al. | |
| 2008/0066904 | A1 | 3/2008 | van Hal et al. | |
| 2008/0111064 | A1 | 5/2008 | Andrews et al. | |
| 2009/0126996 | A1 | 5/2009 | Villareal et al. | |
| 2009/0285721 | A1 | 11/2009 | DeGreeve et al. | |
| 2009/0302221 | A1 | 12/2009 | Tavernier et al. | |
| 2010/0000731 | A1 | 1/2010 | Gordon et al. | |
| 2010/0132450 | A1 | 6/2010 | Pomerantz et al. | |
| 2010/0147065 | A1 | 6/2010 | Tan et al. | |
| 2010/0170718 | A1 | 7/2010 | Villareal et al. | |
| 2010/0181472 | A1 | 7/2010 | Csutak | |
| 2011/0023594 | A1 | 2/2011 | Pelletier et al. | |
| 2012/0137764 | A1 | 6/2012 | Lawrence et al. | |
| 2012/0138364 | A1 | 6/2012 | Leonard et al. | |
| 2012/0145400 | A1 | 6/2012 | Harrison et al. | |
| 2012/0149117 | A1 | 6/2012 | Lawrence et al. | |
| 2012/0149604 | A1 | 6/2012 | Lawrence et al. | |
| 2012/0199365 | A1 * | 8/2012 | Patel et al. | 166/373 |
| 2012/0273203 | A1 * | 11/2012 | Lawrence et al. | 166/305.1 |
| 2012/0276648 | A1 | 11/2012 | van Hal et al. | |
| 2013/0020077 | A1 * | 1/2013 | Irani et al. | 166/264 |
| 2013/0056626 | A1 | 3/2013 | Shen et al. | |
| 2013/0071934 | A1 | 3/2013 | Indo et al. | |
| 2013/0075093 | A1 | 3/2013 | van Hal et al. | |
| 2013/0104642 | A1 | 5/2013 | Pelletier et al. | |
| 2013/0118734 | A1 | 5/2013 | Csutak | |
| 2013/0188169 | A1 | 7/2013 | Harrison et al. | |

OTHER PUBLICATIONS

Burgess et al., "Formation Testing and Sampling Through Casing," Oilfield Review, Spring 2002: pp. 47-57.

* cited by examiner

DOWNHOLE MIXING DEVICE FOR MIXING A FIRST FLUID WITH A SECOND FLUID

CROSS-REFERENCE TO RELATED APPLICATION(S)

This patent application is related to commonly owned United States Patent Applications: 1) United States Patent Application Publication No. 2012/0149604 published on Jun. 14, 2012, entitled "CHEMICAL SCAVENGER FOR DOWNHOLE CHEMICAL ANALYSIS", and by Jimmy Lawrence et al.; 2) United States Patent Application Publication No. 2012/0149117 published on Jun. 14, 2012, entitled "HYDROGEN SULFIDE ($H_2S$) DETECTION USING FUNCTIONALIZED NANOPARTICLES", and by Jimmy Lawrence et al.; 3) United States Patent Application Publication No. 2012/0145400 published on Jun. 14, 2012, entitled "A METHOD FOR MIXING FLUIDS DOWNHOLE", and by Christopher Harrison et al.; and 4) United States Patent Application Publication No. 2012/0276648 published on Nov. 1, 2012, entitled "ELECTROSTATICALLY STABILIZED METAL SULFIDE NANOPARTICLES FOR COLORIMETRIC MEASUREMENT OF HYDROGEN SULFIDE", and by Ronald Van Hal et al., all of which are incorporated by reference in their entirety herein.

FIELD

The disclosed subject matter is generally relates to mixing a first fluid with a second fluid in a subterranean environment. More particularly, the disclosed subject matter of this patent specification relates to mixing the first fluid such as a reagent fluid with the second fluid such as formation fluid, wherein at least embodiment includes the reagent fluid as a liquid and the formation fluid as a gas.

BACKGROUND

Mixing fluids with a reliable efficiency in downhole tools is an important process to manipulate downhole fluids, for example one of many purposes may include gas scrubbing and/or colorimetric sensing.

There is a need for an exact mixing volume between two components in a downhole mixing process. To date, there is no known downhole mixing process, however there are various downhole tools such as the MDT and the CHDT (trademarks of Schlumberger) tools that can be useful in obtaining and analyzing fluid samples. The downhole tools such as the MDT tool (see, e.g., U.S. Pat. No. 3,859,851 to Urbanosky, and U.S. Pat. No. 4,860,581 to Zimmerman et al., which are hereby incorporated by reference herein in their entireties) typically include a fluid entry port or tubular probe cooperatively arranged within wall-engaging packers for isolating the port or probe from the borehole fluids. It is noted they also include sample chambers which can be coupled to the fluid entry by a flow line having control valves arranged therein.

Therefore it is necessary to devise methods and devices to overcome at least the above discussed challenges and other technological challenges related to mixing fluids in a subterranean environment.

SUMMARY

The present disclosed subject matter relates to a downhole apparatus for mixing a first fluid with a second fluid in a subterranean environment, the downhole apparatus includes a chamber having a first end, a second end and at least one opening, wherein the at least one opening allows fluid to flow there through. A perforated piston and at least one piston positioned within the chamber, each having a bottom surface and a top surface. Wherein the top surface of the perforated piston is capable of contacting the second end and the top surface of the at least one piston is capable of contacting the bottom surface of the perforated piston. One or more channel within the perforated piston allows for fluid to flow there through, and the perforated piston is located at a first position within the chamber based upon characteristics of a first fluid. A first fluid delivery system for supplying the maximum volume of the first fluid to the chamber, a second fluid delivery system for supplying a second fluid to the chamber, wherein the second fluid is at a pressure that moves the at least one piston approximate to the first end, the second fluid delivery system closes the at least one opening. Finally, an actuating device applies a force against the bottom surface of the at least one piston to inject the fluids through the one or more channel from the bottom surface through to the top surface of the perforated piston to produce spray droplets.

According to aspects of the subject matter disclosed, the characteristics of the second fluid can include a compressibility volume change of the second fluid and a volume of the first fluid flowing through the perforated piston. Further, the characteristics of the second fluid can provide for a maximum volume of the first fluid, the maximum volume of the first fluid is configured by a volume change upon compression of the second fluid such that at least approximately 15%, 20%, 25%, 30%, 35% or possibly within a range of 15% to 50% of the first fluid flows through the perforated piston. It is noted, the first fluid can be a reactant fluid including a neutralizing acid, a base or pH balancing agent, a salt containing at least one salt-out organic compound such as for removing water or some similar type of reactant fluid. Further still, the first fluid can be a reactant fluid, the reactant fluid may be from the group consisting of one of $H_2S$ detection, $CO_2$ detection, Hg detection or one or more molecule of the second fluid. It is possible the second fluid is a formation fluid that can be one of a gas, a liquid or some combination thereof.

According to aspects of the subject matter disclosed, wherein producing the spray droplets is partially due to one of: the one or more channels of the perforated piston being one of linear, non-linear or both; or a mechanism incorporated into the perforated piston to increase friction in the chamber allowing for a higher spraying pressure. The one or more channels of the perforated piston can be two or more channels. Further, at least one channel of the two or more channels can be one of partially angled along the channel, include two or more outlets of the channel on the top surface of the perforated piston, include two or more inlets of the channel on the bottom surface of the perforated piston, include a larger diameter at an inlet of the channel on the bottom surface of the perforated piston than a outlet diameter of the channel on the top surface of the perforated piston, or some combination thereof. Further still, the second fluid delivery system can be in communication with a downhole tool having an inlet disposed on an exterior of the downhole tool for engaging a formation in the subterranean environment, the downhole tool can have a chamber fluidly connected to the inlet, so a test fluid may be disposed in the chamber, the chamber containing the test fluid is fluidly connected to the chamber wherein the test fluid is capable of being the second fluid. Wherein a mass of the sprayed fluid mixture can be in droplets. It is possible the sprayed fluid mixture can provide for one of: increasing a surface to volume ratio of the first fluid to significantly increase the contact area between the first and second fluid, so there is reaction or mixing with the second fluid; a manipulation of the fluid mixture properties such as one of a compound extraction; or a compound stripping of the second fluid by the first fluid. Further still, the downhole apparatus can be used for one of a gas scrubbing, a colorimetric sensing measurement, downhole measurements such as electrochemical sensing or magnetic resonance sensing. It is also possible, another application may include chemical treatment to improve sample conservation for sample analysis uphole.

According to aspects of the subject matter disclosed, the actuating device can apply multiple forces against the at least one piston, such as the force directing the at least one piston toward the second end and another force directing the at least one piston toward the first end. The mixing device can further comprise of a second piston of the at least one piston, the second piston can be capable of contacting the bottom surface of the piston and includes at least one magnet to identify a location of the at least one piston during the mixing of the first fluid with the second fluid. Further, the mixing device can further comprise of at least one sealing device for each of the perforated piston and the at least one piston, wherein the sealing device is from the group consisting of one of at least one o-ring or one or more elastomeric device.

According to aspects of the subject matter disclosed, the top surface of the at least one piston can be symmetrically formed to the bottom surface of the perforated piston. Further, the top surface of the at least one piston can be one of linear, non-linear, geometric shaped or some combination thereof. It is possible the top surface of the perforated piston may be symmetrically formed to the second end. Further, the top surface of the perforated piston can be one of linear, non-linear or some combination thereof so as to enhance one of a spraying effect or a fluid mixture flow exiting the chamber. It is noted that the chamber, the at least one piston or the perforated piston can include one or more coatings, such as at least one coating is capable for manipulation of the second fluid containing hydrogen sulfide ($H_2S$). It is also possible the chamber, the at least one piston or the perforated piston be at least partially made of or include at least one coating having a material with material properties/characteristic that do not scavenge the analytes. For example, the material with material properties/characteristic may include: silicon, a processed/synthetic diamond, other inert materials, titanium, other metal alloys, glass, polymer-glass mixtures, carbon nanotube-polymer composites, polymer metal composites (such as an O-ring). Further, at least one spring device can be positioned between the top surface of the perforated piston and the second end of the chamber.

According to aspects of the subject matter disclosed, the at least one channel of the one or more channel can have a diameter in a range between 10 microns to 5 centimeters. Further, at least one channel of the one or more channel can have a diameter in a range between 0.2 millimeters to 1 millimeter. It is possible the top surface of the perforated piston can include at least one nozzle that is one of unitary or detachable extending away from the top surface of the perforated piston. It is possible the nozzle may be a telescoping nozzle extending away from the top surface when fully extended, having one or more outlets.

According to aspects of the subject matter disclosed, a length of the one or more channel is dependent on determining an amount of generated force by the resistance difference over a resistance that places the perforated piston in motion to a resistance (maximum static friction force) that keeps the perforated piston stationary, the generated force is less than a force required to move the perforated piston. For example, it is important that the perforated piston remains at the same position during mixing but can be moved after the mixing is completed. This can be achieved by the use of one or more O-rings. The maximum static friction force generated by the O-rings should therefore be higher than the force generated by the pressure difference over the perforated piston during compression and decompression.

The maximum static friction force is given by:

$$F_{s,max}=\mu_s N$$

where:

$F_{s,max}$ is the maximum static friction force $\mu_s$ is the coefficient of static fraction N is the normal force generated by the compression of the O-rings.

The force generated by the pressure difference over the perforated piston is given by:

$$F=\Delta p*A=\Delta p*\pi r^2$$

Where:

F is the force pushing the perforated piston $\Delta p$ is the pressure difference between top and bottom of the perforated piston A is the surface area of the perforated piston r is the radius of the perforated piston Under the restriction of laminar flow, the pressure difference over the perforated piston is given by the Hagen-Poiseuille equation:

$$\Delta p = \frac{8\eta l_c Q}{\pi r_c^4}$$

Where:

$\eta$ is the viscosity of the reagent;

$l_c$ is the length of the channel;

Q is the volumetric flow rate; and $r_c$ is the radius of the channel.

In accordance with another embodiment of the disclosed subject matter, a downhole method of mixing a first fluid with a pressurized second fluid by forming fluid droplets by spraying a pressurized fluid mixture. The method includes the steps of: (a) positioning a perforated piston having a top surface and a bottom surface within a chamber, wherein the perforated piston is located at a first position within the chamber based upon characteristics of a second fluid, the chamber having a first end, a second end and at least one opening; (b) introducing the first fluid into the chamber, wherein the perforated piston has one or more channel for fluid to flow there through; (c) introducing the pressurized second fluid into the chamber, the pressurized second fluid partially mixes with the first fluid, the fluid mixture flows through the one or more channel from the top surface and exits the bottom surface of the perforated piston to move at least one piston to approximately the first end of the chamber, closing the at least one opening; (d) actuating a bottom surface of the at least one piston with an actuating device to move the at least one piston from the first end toward the second end of the chamber to inject the fluid mixture through the one or more channel from the bottom surface through to the top surface of the perforated piston to produce spray droplets, wherein a top surface of the at least one piston is capable of contacting the bottom surface of the perforated piston; (e) actuating the bottom surface of the at least one piston with the actuating device to move the at least one piston from the second end to the first end of the chamber; (f) repeating steps (d) and (e) one or more times; and finally (g) opening the at least one opening, actuating the bottom surface of the at least one piston with the actuating device to move the at least one piston from the first end to the second end of the chamber to exit the fluid mixture out of the chamber, wherein the top surface of the at least one piston contacts the bottom surface of the perforated piston and the top surface of the perforated piston contacts the second end of the chamber.

Further, it is possible that when the fluid was introduced and partially mixes that the volume correction is not strictly needed. For example, entry of the second fluid can be controlled by pumping pump fluid out slowly. Pumping may add error on the actual amount of the second fluid which comes in if the second piston is very difficult to move. Further still, it may be more suitable for liquid-liquid mixing if the second fluid volume is defined and gas is added at a later time. Another possibility may allow for mixing if the entry of the second fluid was due to a high pressure of the second fluid. However, this may not be suitable for liquid-liquid mixing as the second fluid may fill the whole chamber, such that a volume correction may be required. Further, if there is no control of the fluid entry, then the volume error of the second fluid may be suppressed.

According to aspects of the subject matter disclosed, wherein step (g) further comprises a downhole tool for housing the chamber wherein the exiting fluid mixture is in communication via a fluid mixture flow line with at least one external detector located in the downhole tool. Wherein step (g) includes the first fluid and the second fluid exiting the chamber as a homogenous fluid. Further, the perforated piston can remain in the first position from step (b) through to step (f). It is also noted that the fluids may be transferred to another cylinder. The fluids that can be separated for example oil and water, can be respectively transferred to different locations.

According to aspects of the subject matter disclosed, the characteristics of the second fluid include a compressibility volume change of the second fluid and a volume of the first fluid flowing through the perforated piston. Further, the characteristics of the second fluid can provide for a maximum volume of the first fluid, the maximum volume of the first fluid is configured by a volume change upon compression of the second fluid such that at least 25% (or as noted above 15%, 20%, 25%, 30%, 35% or possibly a range of 15% to 50%) of the first fluid flows through the perforated piston. Wherein step (d) can include the first fluid is a reagent fluid and the second fluid is a formation fluid, and the creating of the spray droplets results in a larger surface for the reagent fluid to react with the formation fluid. Wherein step (d) can provide spray droplets that one of increases a surface to volume ratio of the first fluid to significantly increase reaction or mixing with the second fluid, manipulates the fluid mixture properties such as a compound extraction or a compound stripping of the second fluid by the first fluid. The method can include the second fluid being a formation fluid that is one of a gas, a liquid or some combination thereof. Wherein producing the spray droplets can be partially due to the one or more channels of the perforated piston being one of linear, non-linear or both. Further, wherein producing the spray droplets can be partially due to the one or more channels of the perforated piston being two or more channels. It is noted that producing the spray droplets or streams can be partially due to at least one channel of the two or more channels being one of partially angled along the channel, including two or more outlets of the channel on the top surface of the perforated piston, including two or more inlets of the channel on the bottom surface of the perforated piston, including a larger diameter at an inlet of the channel on the bottom surface of the perforated piston than a outlet diameter of the channel on the top surface of the perforated piston, or some combination thereof. It is possible the second fluid delivery system is in communication a downhole tool having an inlet disposed on an exterior of the downhole tool for engaging a formation in a subterranean environment, the downhole tool has a chamber fluidly connected to the inlet, so a test fluid is disposed in the chamber which is capable of being used as the second fluid. It is noted that producing the spray droplets can be assisted by the at least one piston and the perforated piston each having at least one sealing device, wherein the at least one sealing device is from the group consisting of one of at least one o-ring or one or more elastomeric device.

It is noted at least one portion of the first piston may be reshaped or designed to include: one or more void to reduce the weight (inertia) of the piston so as to maximize the friction (multiple O-ring). Further, the one or more voids may at the final step, allow for small amount of liquids to remain (or to be collected) for further analysis at surface so as to confirm reaction, mixing efficiency and/or other types of identifications.

According to aspects of the subject matter disclosed, the method can also include chamber, the at least one piston or the perforated piston that is coated with one or more coatings, such as at least one coating capable manipulating the second fluid containing hydrogen sulfide ($H_2S$). It is possible the top surface of the at least one piston can be configured to symmetrically form to the bottom surface of the perforated piston. Further, the top surface of the at least one piston can be configured to be one of linear, non-linear, geometric shaped or some combination thereof. It is possible the top surface of the perforated piston can be configured to symmetrically form to the second end of the chamber. Further still, the top surface of the perforated piston can be one of linear, non-linear or some combination thereof, so as to enhance one of a spraying effect or an increased flowing effect of the fluid mixture exiting the chamber Further features and advantages of the disclosed subject matter will become more readily apparent from the following detailed description when taken in conjunction with the accompanying Drawings.

BRIEF DESCRIPTION OF THE DRAWINGS

The present disclosed subject matter is further described in the detailed description which follows, in reference to the noted plurality of drawings by way of non-limiting examples of exemplary embodiments of the present disclosed subject matter, in which like reference numerals represent similar parts throughout the several views of the drawings, and wherein.

DETAILED DESCRIPTION OF THE PREFERRED EMBODIMENTS

Figure 1:
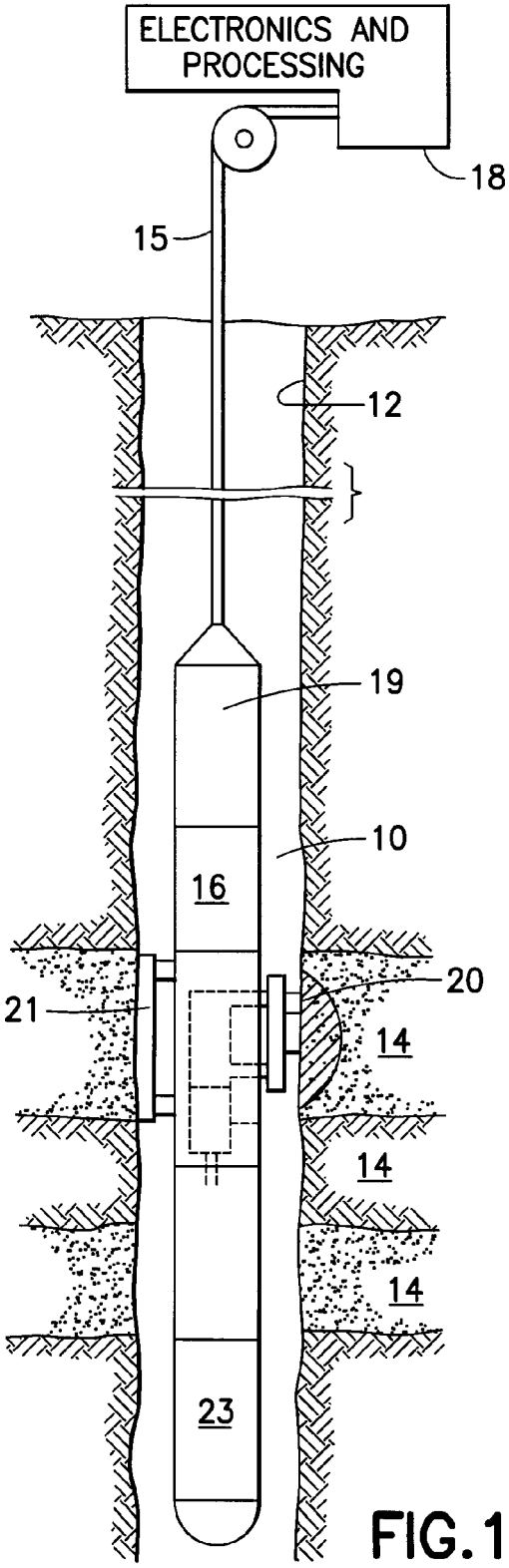
FIG. 1 shows a prior art schematic diagram showing a downhole/borehole tool with an sampling port.

The particulars shown herein are by way of example and for purposes of illustrative discussion of the embodiments of the present disclosed subject matter only and are presented in the cause of providing what is believed to be the most useful and readily understood description of the principles and conceptual aspects of the present disclosed subject matter. In this regard, no attempt is made to show structural details of the present disclosed subject matter in more detail than is necessary for the fundamental understanding of the present disclosed subject matter, the description taken with the drawings making apparent to those skilled in the art how the several forms of the present disclosed subject matter may be embodied in practice. Further, like reference numbers and designations in the various drawings indicated like elements.

The present disclosed subject matter relates to a downhole apparatus for mixing a first fluid with a second fluid in a subterranean environment, the downhole apparatus includes a chamber having a first end, a second end and at least one opening, wherein the at least one opening allows fluid to flow there through. A perforated piston and at least one piston positioned within the chamber, each having a bottom surface and a top surface. Wherein the top surface of the perforated piston is capable of contacting the second end and the top surface of the at least one piston is capable of contacting the bottom surface of the perforated piston. One or more channel within the perforated piston allows for fluid to flow there through, and the perforated piston is located at a first position within the chamber based upon characteristics of a first fluid. A first fluid delivery system for supplying the maximum volume of the first fluid to the chamber, a second fluid delivery system for supplying a second fluid to the chamber, wherein the second fluid is at a pressure that moves the at least one piston approximate to the first end. Finally, an actuating device applies a force against the bottom surface of the at least one piston to inject the fluids through the one or more channel from the bottom surface through to the top surface of the perforated piston to produce spray droplets.

Further, the subject matter disclosed relates to methods and devices (or apparatuses) mixing a first fluid such as a reagent fluid with a second fluid such as formation fluid in a downhole environment, wherein at least embodiment includes the reagent fluid as a liquid and the formation fluid as a gas. For example, the mixing process will likely be in a tool such as a downhole tool, but other possible devices may be considered. Further, the subject matter disclosed provides many advantages, by non-limiting example, an advantage of mixing downhole fluids effectively in downhole tools. Formation gas or formation liquid can be transferred in to a sample bottle (MPSR) in Schlumberger MRMS Module of the Modular Dynamics Tester (MDT) or other similar types of devices. Another possible advantage, among the many advantages, is that the methods and devices can improve the surface area available for mixing of two fluids (gas-liquid, liquid-liquid, liquid-gas) in a bottle. It is noted that a bottle can be considered a cavity, chamber or any device able to hold fluids.

Regarding the downhole tools and methods which expedite the sampling of formation hydrocarbons, the downhole tools, i.e., sampling tools, are utilized to carry downhole the mixing device(s) of the subject matter disclosed in this application. By way of example and not limitation, tools such as the previously described MDT tool of Schlumberger (see, e.g., previously incorporated U.S. Pat. No. 3,859,851 to Urbanosky, and U.S. Pat. No. 4,860,581 to Zimmerman et al.) with or without OFA, CFA or LFA module (see, e.g., previously incorporated U.S. Pat. No. 4,994,671 to Safinya et al., U.S. Pat. No. 5,266,800 to Mullin, U.S. Pat. No. 5,939,717 to Mullins), or the CHDT tool (see, e.g., previously incorporated "Formation Testing and Sampling through Casing", Oilfield Review, Spring 2002) may be utilized. An example of a tool having the basic elements to implement the subject matter as disclosed in the application as seen in schematic in FIG. 1.

The subject matter disclosed in the application discloses apparatuses and methods for mixing downhole fluids effectively in downhole tools. Formation gas or formation liquid can be transferred in to a sample bottle (MPSR) in Schlumberger MRMS Module of the Modular Dynamics Tester (MDT) as noted above. Further, the apparatuses and methods can improve the surface area available for mixing of two fluids (gas-liquid, liquid-liquid, liquid-gas) in the bottle. Once the formation fluid is captured, a regular piston will be moved to push another fluid through a second piston equipped with holes to create spray effect. Further still, by using the subject matter disclosed to create fluid spray, surface to volume ratio of one fluid to react or mix with another fluid can be significantly increased. This can improve reaction efficiency, reduce the operation time and increase mixing efficiency, among other improvements and advantages. Realtime downhole operations involving chemical reaction, fluid properties manipulation (viscosity, compound extraction), compound stripping can be enabled and can be enhanced by the disclosed subject matter in the application.

According to an aspect of the subject matter disclosed, it is possible for simultaneous fluid manipulations and mixing followed by storage or analysis to be done realtime in downhole. For example, this can be useful for improving analysis quality, providing separation, extraction, neutralization (protecting specific reagent/mechanical/sensory components from aggressive compounds/corrosion), avoiding cross contamination, false positive, etc. Further, it may also provide for increasing contact area between two different fluid components, for example gas and liquid by several magnitudes higher than simple compression-decompression cycles, reducing operation time and risk for component failures in downhole environment. Further still, this process will enable various fluid manipulations in a closed and/or a partially closed container, that may include reaction, separation, cleaning, extraction, techniques (which are mostly available on the surface and usually require manual operations), but this is for automated process in downhole environment.

FIG. 1 shows a borehole logging tool 10 for testing earth formations and optionally analyzing the composition of fluids from the formation 14 in accord with subject matter as disclosed in the application as seen. As illustrated, the tool 10 is suspended in the borehole 12 from the lower end of a typical multiconductor cable 15 that is spooled in the usual fashion on a suitable winch (not shown) on the formation surface. On the surface, the cable 15 is electrically connected to an electrical control system 18. The tool 10 includes an elongated body 19 which encloses the downhole portion of the tool control system 16. The elongated body 19 carries a probe 20 and an anchoring member 21 and/or packers (not shown in FIG. 1). The probe 20 is preferably selectively extendible as is the anchoring member 21 and they are respectively arranged on opposite sides of the body. The probe 20 is equipped for selectively sealing off or isolating selected portions of the wall of borehole 12 such that pressure or fluid communication with the adjacent earth formation is established. Also included with tool 10 is a fluid collecting chamber block 23.

Figure 2:
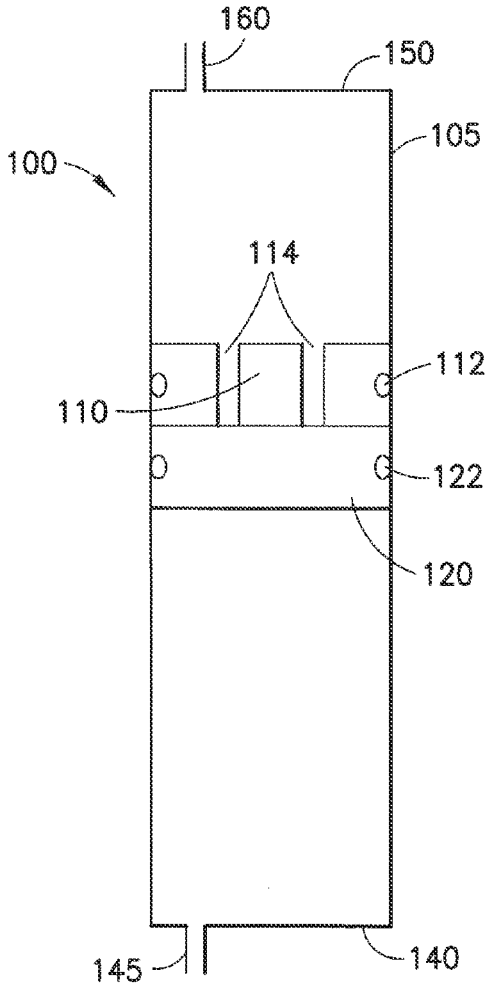
FIG. 2 shows at least one mixing device, according to the disclosed subject matter.

FIG. 2 shows at least one mixing device according to the disclosed subject matter. In particular, a mixing device (100) includes a chamber (105) having an opening (160), a perforated piston (110) and at least one piston (120). It is noted that the perforated piston (110) is installed on the top of piston (120). The perforated piston's (110) position is fixed with high friction from one or more o-rings (112) or similar like elastomeric devices. The perforated piston's (110) location should be calculated before putting the first fluid into the chamber (105), i.e., bottle or cavity, for optimized mixing. The opening (160) can be for an inlet for a second fluid, such as a formation fluid. It is noted the formation fluid may be a gas, liquid or some combination thereof. Further, the chamber (160) includes a first end (140) and a second end (150), wherein the opening (160) appears exiting the second end (150). However, it is contemplated that the opening (160) may be located elsewhere along the outer perimeter of the chamber (105). It is also contemplated that there may be one or more openings, for example, one opening for an inlet of the second fluid and another inlet (not shown) for exiting of fluids such as a fluid mixture. The chamber (105) also shows an opening (145) for an actuating device (not shown) along the first end (140) of the chamber. However, it is contemplated that the opening (145) may be located elsewhere along the outer perimeter of the chamber (105). The actuating device (not shown) may be from a group consisting of one of: a device that pushes fluid to move piston (120); a mechanical device to move piston (120); or a compression related device that moves piston (120). It is noted that the actuating device actuates both in a direction toward the second end (150) of the chamber (105) as well as in a reverse direction toward the first end (140) of the chamber (105).

Still referring to FIG. 2, the perforated piston (110) may include one or more channels (114). Further, the perforated piston (110) also includes at least one sealing device (112) positioned between the perforated piston (110) and the inside wall of the chamber (105). It is contemplated that the sealing device may be from the group consisting of one of: an o-ring, an elastomeric device or a device that seals fluid from one location to another. The piston (120) also has a sealing device (122) which may be the same sealing device as the sealing device (112) used for the perforated piston (110). However, it is possible that the perforated sealing device (112) may be of a different material having different material and functional properties than the piston sealing device (122). Further, there may be two or more sealing devices for both the perforated sealing device (112) and the piston sealing device (122), and it is conceivable that there may be more sealing devices for the perforated sealing device (112) than the piston sealing device (122) or vice a versa.

Still referring to FIG. 2, the amount of first fluid introduced into the chamber is of particular interest for the operation of the mixing device, wherein the second fluid is compressible. For example, a maximum volume of the first fluid, i.e., reagent fluid, must be calculated based upon many factors. In particular, the maximum volume of the first fluid should be such that the volume change upon compression of the second fluid, i.e., formation fluid, is such that at least 25% (or as noted above 15%, 20%, 25%, 30%, 35% or possibly a range of 15% to 50%) of the first fluid would flow through the perforated piston (110). The perforated piston (110) should be placed above the first fluid such that all of the first fluid can be below the perforated piston (110) and that at least 25% of first fluid will go through the perforated piston (110). Or in formula's: Assuming that the temperature is constant:

$$Z_1P_1V_1=Z_2P_2V_2$$

With $Z_1$, $P_1$, $V_1$, $Z_2$, $P_2$ and $V_2$ being the compressibility factor, the pressure and volume of the compressible fluid before and after compression. The compressibility factor is a function of temperature, pressure and gas composition, and is used to modify the ideal gas law to account for the real gas behavior. The compressibility factor is the ratio of the volume actually occupied by a gas at given pressure and temperature to the volume, the gas would occupy at the same pressure and temperature if it behaved like an ideal gas. The expected volume change $\Delta V$ is then:

$$\Delta V = V_1 - V_2 = V_1 - \frac{Z_1 P_1 V_1}{Z_2 P_2} \quad \text{Eq. 2}$$

Still referring to FIG. 2, a for example, it is important that the perforated piston remains at the same position during mixing but can be moved after the mixing is completed. This can be achieved by the use of one or more O-rings. The maximum static friction force generated by the O-rings should therefore be higher than the force generated by the pressure difference over the perforated piston during compression and decompression.

The maximum static friction force is given by:

$$F_{s,max} = \mu_s N \quad \text{Eq. 3}$$

where:

$F_{s,max}$ is the maximum static friction force $\mu_s$ is the coefficient of static fraction N is the normal force generated by the compression of the O-rings.

The force generated by the pressure difference over the perforated piston is given by:

$$F = \Delta p * A = \Delta p * \pi r^2 \quad \text{Eq. 4}$$

Where:

F is the force pushing the perforated piston

Δp is the pressure difference between top and bottom of the perforated piston

A is the surface area of the perforated piston r is the radius of the perforated piston Under the restriction of laminar flow, the pressure difference over the perforated piston is given by the Hagen-Poiseuille equation:

$$\Delta p = \frac{8\eta l_c Q}{\pi r_c^4} \quad \text{Eq. 5}$$

Where:

η is the viscosity of the reagent $l_c$ is the length of the channel

Q is the volumetric flow rate $r_c$ is the radius of the channel

It is noted that the pressure difference between the top and bottom of the perforated piston (dP) should be divided by number of channels in the perforated piston (110). Further, by reducing the number of channels, i.e., holes, can create a higher spray with longer exposure time. The mixing and spraying process can also be controlled by the use of the regular piston equipped with magnet, and the mixing can be further enhanced by some additional mechanical parts. Wherein the magnetic component may be positioned outside of the cylinder to interact with the magnetic component in one or both pistons. It is possible the increase/decrease in magnetic field relative to the sensor placed at the top and bottom of the cylinder can enable a qualitative indication of position changes of these pistons.

Still referring to FIG. 2, for a one inch (1") outer diameter (OD) and three fourths inch (¾") inner diameter (ID) chamber, i.e., bottle, equipped with perforated piston, if the piston is moved with a volumetric flow rate that is 25 mL/min, the viscosity of water is taken and the perforated piston has a thickness of 0.5", a 0.062" hole will create almost no dP (i.e., pressure difference between the top and bottom of the perforated piston), such as 0.005 psi. It is noted that the following channel diameters resulted in a certain pressure per square inch, for example: –0.03" channel diameter: 0.1 psi; –0.02" channel diameter: 0.47 psi; and –0.01" channel diameter: 7.52 psi. Still referring to FIG. 2, if a very small channel diameter is used, for example about 0.020", it is possible to increase the mixing capabilities and decrease the quantity of the mixing cycles. Thus, it would be beneficiary to put this channel on the periphery of the piston with an angle of about 45-60° to the vertical axis. Because at this angle the second fluid, i.e., first substance, will create a vortex inside the first substance. The second fluid, i.e., second substance, will travel and be in contact with the first substance for a longer period of the time which will help to quickly mix the two substances. This will also increase the possibility to leave droplets on the cylinder wall, to create higher surface area for reaction.

Still referring to FIG. 2, the length and radius of the one or more channel (114) is of particular interest for the operation of the mixing device. For example, the length and radius of the one or more channel (114) is a calculated length and radius based on many factors. In particular, a length and radius of the one or more channel (114) can be such that when the actuating device (not shown) pushes the fluids toward the second end (150) of the chamber (105), there is a force generated by the resistance difference over the perforated piston (110) being placed in motion (i.e., when the fluid is being pushed into the channel the size of the channel generates a resistance), to a resistance keeping the perforated piston stationary, the generated force is less than the force required to move the perforated piston (114).

Figure 3A:
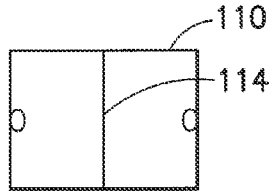
FIGS. 3A-3O shows multiple variations of the channel design within the perforated piston, wherein the channel maybe be one of linear, non-linear, have two entries in either end of the perforated piston, as well as having a varying diameter along the channel such that at least one portion of the channel has a diameter larger than another portion of the channel, according to the disclosed subject matter.
Figure 3B:
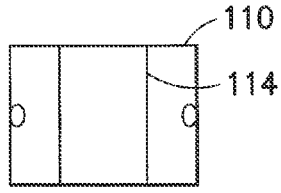
Figure 3C:
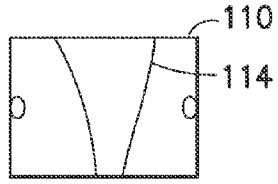
Figure 3D:
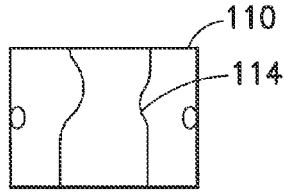
Figure 3E:
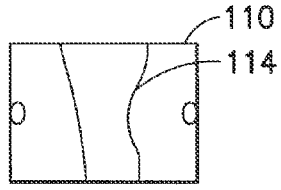
Figure 3F:
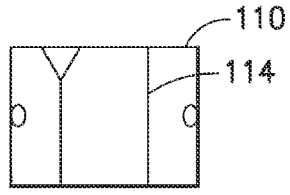
Figure 3G:
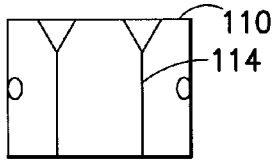
Figure 3H:
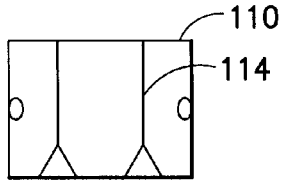
Figure 3I:
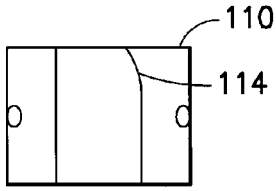
Figure 3J:
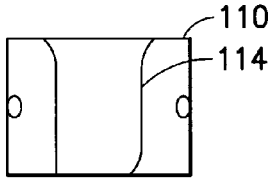
Figure 3K:
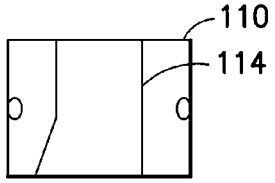
Figure 3L:
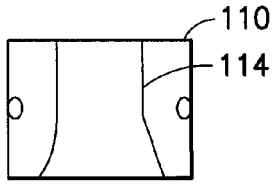
Figure 3M:
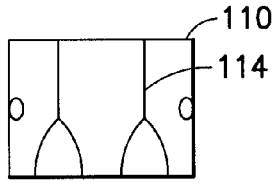
Figure 3N:
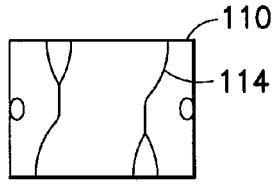
Figure 3O:
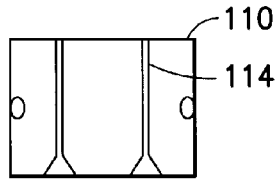

FIGS. 3A-3O shows multiple variations of the channel (114) design within the perforated piston (110), wherein the channel (114) maybe be one of: linear and/or non-linear; have two entries in either end or both of the perforated piston; as well as have a varying diameter along the channel such that at least one portion of the channel has a diameter larger than another portion of the channel. FIG. 3A shows the perforated piston (110) having a single channel (114) that is linear. FIG. 3B shows the perforated piston (110) having two channels (114) that are linear. FIG. 3C shows the perforated piston (110) having two channels (114) that are linear both at an angle. It is possible that one channel could be at a different angle than the other channel. FIG. 3D shows the perforated piston (110) having two channels (114) that are non-linear, for example, the channels one or the other could be wave-like. It is possible that one channel could be exiting toward the second end of the chamber at a different angle than the other channel or that the inlet opening toward the first end of the chamber could be a different angle then the other channel. FIG. 3E shows the perforated piston (110) having two channels (114) where one channel is linear at an angle and the other channel is non-linear. FIG. 3F shows the perforated piston (110) having two channels (114) where one channel has two exit openings out toward the second end of the chamber and the other channel has only one exit. FIG. 3G shows the perforated piston (110) having two channels (114) with both channels having two exit openings out toward the second end of the chamber. FIG. 3H shows the perforated piston (110) having two segmented linear channels (114) with both channels having two exit openings out toward the first end of the chamber. FIG. 3I shows the perforated piston (110) having two channels (114) where one channel is linear at an angle and the other channel is non-linear at the exit opening out toward the second end of the chamber. FIG. 3J shows the perforated piston (110) having two channels (114) with both non-linear channels having two exit opening out toward the second end of the chamber as well as one channel having a non-linear channel at the exit opening out toward the first end of the chamber. FIG. 3K shows the perforated piston (110)

having two channels (114) with one linear and the other non-linear channels having an exit opening out toward the first end of the chamber. FIG. 3L shows the perforated piston (110) having both two channels (114) non-linear that have the exit openings out toward the first end of the chamber. FIG. 3M shows the perforated piston (110) having two channels (114) with both non-linear channels having two exit openings out toward the first end of the chamber. FIG. 3N shows the perforated piston (110) having two channels (114) with two exit openings on at least one end of the channel, one channel as the two exit openings on the second end of the chamber and the other has two exit openings on the first end of the channel, and both channels have at least one single exit opening. FIG. 3N shows the perforated piston (110) having two channels (114) where both channels have a varying diameter on at least one side of the perforated piston.

Figure 4:
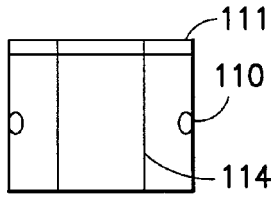
FIG. 4 shows the perforated piston having an attachable nozzle, wherein the nozzle may be one of unitary or attachable to the perforated piston, according to embodiments of the disclosed subject matter.

FIG. 4 shows the perforated piston (110) have a nozzle (111) toward the second end (150) of the chamber (110), wherein the nozzle is one of unitary with the perforated piston or attachable to the perforated piston.

Figure 5A:
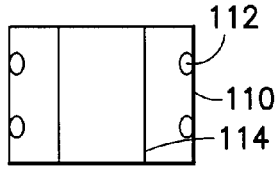
FIG. 5A shows the perforated piston having more than one sealing device, according to embodiments of the disclosed subject matter.
Figure 5B:
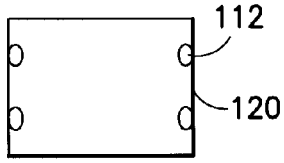
FIG. 5B shows the piston having more than one sealing device, according to embodiments of the disclosed subject matter.

Referring to FIGS. 5A and 5B, FIG. 5A shows the perforated piston (110) having at least two sealing elements (112). FIG. 5B shows the piston (110) having at least two sealing elements (112).

Figure 6A:
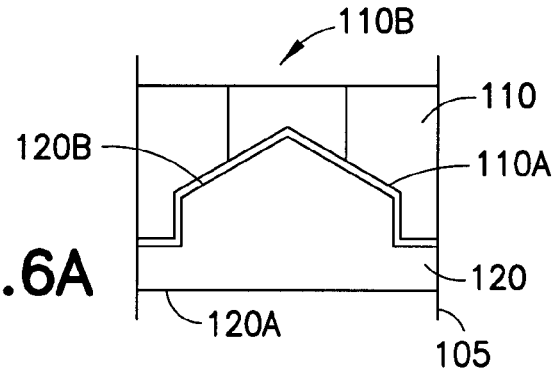
FIG. 6A shows a top surface of the piston is symmetrically formed to a bottom surface of the perforated piston, wherein the shape has linear portions on the surface, according to embodiments of the disclosed subject matter.
Figure 6B:
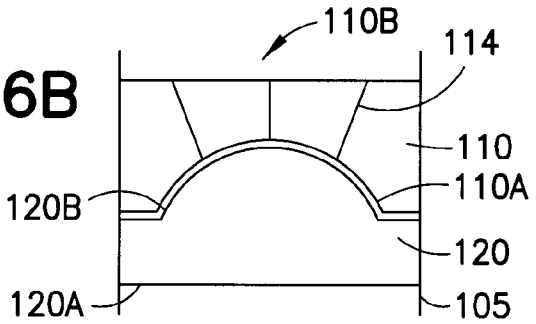
FIG. 6B shows a top surface of the at least one piston being symmetrically formed to a bottom surface of the perforated piston, wherein the shape has linear and non-linear portions on the surface, according to embodiments of the disclosed subject matter.
Figure 6C:
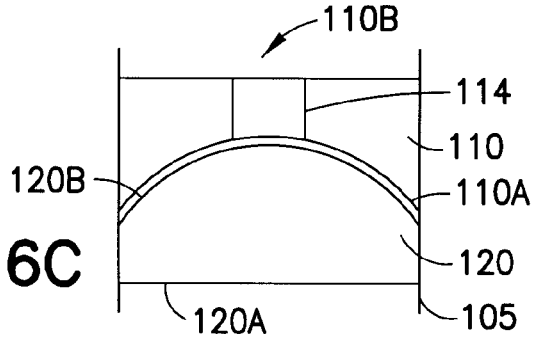
FIG. 6C shows a top surface of the at least one piston being symmetrically formed to a bottom surface of the perforated piston, wherein the shape is non-linear on the surface, according to embodiments of the disclosed subject matter.
Figure 6D:
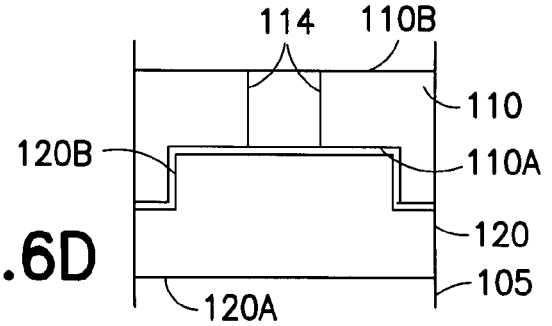
FIG. 6D shows a top surface of a piston linearly segmented and symmetrically formed to a bottom surface of a perforated piston within the chamber, according to embodiments of the disclosed subject matter.

Referring to FIGS. 6A, 6B, 6C and 6D, FIG. 6A shows a top surface (120B) of piston (120) linearly segmented and symmetrically formed to a bottom surface (110A) of the perforated piston (110) within the chamber (105). The bottom surface (120A) of piston (120) is also referenced and the top surface (110A) of the perforated piston (110) is referenced. FIG. 6B shows a top surface (120B) of piston (120) at least partially linearly as well as partially non-linear and symmetrically formed to a bottom surface (110A) of the perforated piston (110) within the chamber (105). FIG. 6C shows a top surface (120B) of piston (120) non-linear and symmetrically formed to a bottom surface (110A) of the perforated piston (110) within the chamber (105). FIG. 6D shows a top surface (120B) of piston (120) linearly segmented and symmetrically formed to a bottom surface (110A) of the perforated piston (110) within the chamber (105).

Figure 7A:
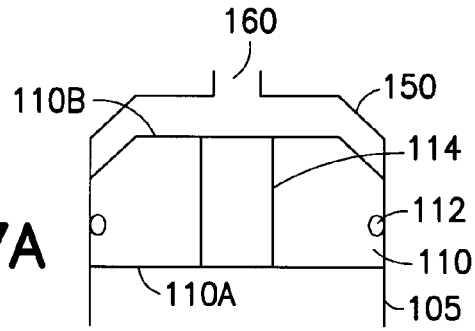
FIG. 7A shows a top surface of the perforated piston being symmetrically formed to the second end of the chamber, wherein the shape has linear portions on the surface, according to embodiments of the disclosed subject matter.
Figure 7B:
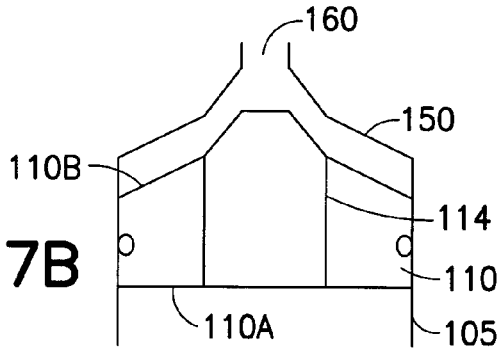
FIG. 7B shows a top surface of the perforated piston being symmetrically formed to the second end of the chamber, wherein the shape has linear and non-linear portions on the surface, according to embodiments of the disclosed subject matter.
Figure 7C:
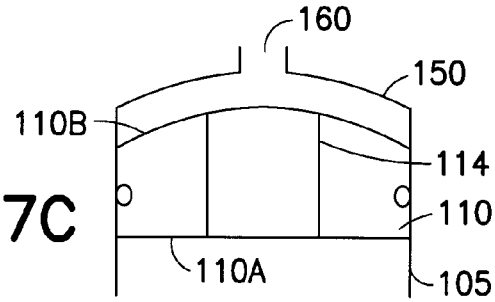
FIG. 7C shows a top surface of the perforated piston being symmetrically formed to the second end of the chamber, wherein the shape is non-linear on the surface, according to embodiments of the disclosed subject matter.
Figure 7D:
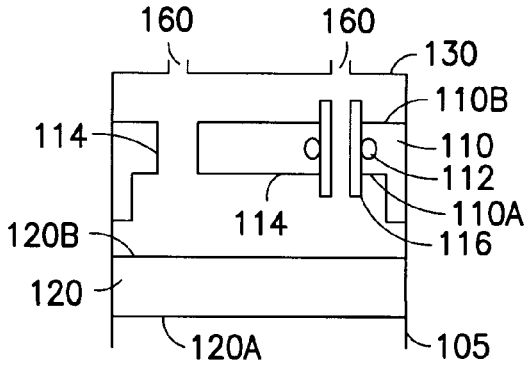
FIG. 7D shows at least one channel with a moveable insert, wherein the moveable insert further provides for an additional spraying effect, according to embodiments of the disclosed subject matter.

Referring to FIGS. 7A, 7B, 7C and 7D, FIG. 7A shows a top surface (110B) of perforated piston (110) linearly segmented and symmetrically formed to the second end (150) of the chamber (105) within the chamber (105). The bottom surface (110A) of perforated piston (110) is also referenced. FIG. 6B shows a top surface (110B) of perforated piston (110) at least partially linearly as well as partially non-linear and symmetrically formed to the second end (150) of the chamber (105) within the chamber (105). FIG. 6C shows a top surface (110B) of perforated piston (110) non-linear and symmetrically formed to the second end (150) of the chamber (105) within the chamber (105). FIG. 7D shows that at least one channel of the one or more channel may include moveable insert 116, wherein the moveable insert 116, by non-limiting example and among other things, further provides for an additional spraying effect. For example, the perforated piston 110 can include at least one moveable insert 116 with a sealing device 112 within a channel 105 that is capable of extending above the top surface 110B of the perforated piston 110.

Figure 8:
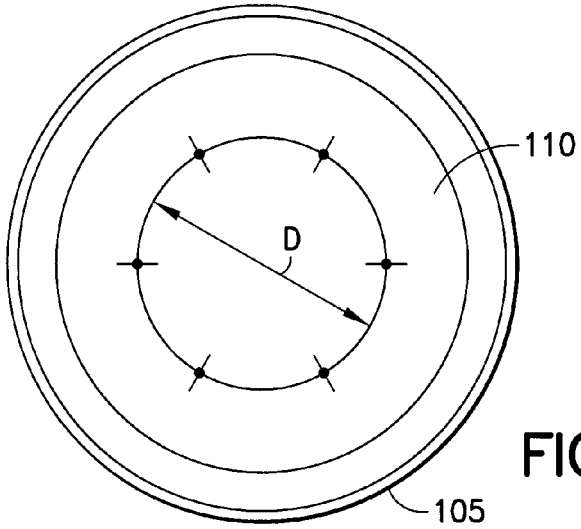
FIG. 8 shows a front view of perforated piston, wherein the perforated piston is installed in chamber, according to embodiments of the disclosed subject matter.

FIG. 8 shows a front view of perforated piston, wherein the perforated piston (110) is installed in chamber (105). Further, the diameter (D) of the perforated piston (110) is illustrated. Further still, the one or more channel (114) can have a diameter in a range between 10 microns to 5 centimeters, in particular, a diameter in the range of 0.2 millimeter to 1 millimeter may be optimum.

Figure 9:
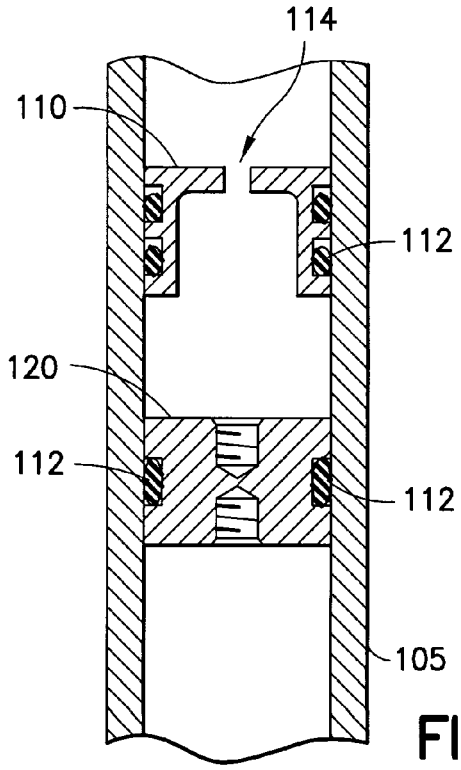
FIG. 9 shows an optional perforated piston shape within the chamber, according to embodiments of the disclosed subject matter.

FIG. 9 shows at least one an optional perforated piston shape (110) within the chamber (105). It is possible that perforated piston can be many different shapes so long as the length of the channel (114) is such that it is long enough for the mixing device to operate.

Figure 10:
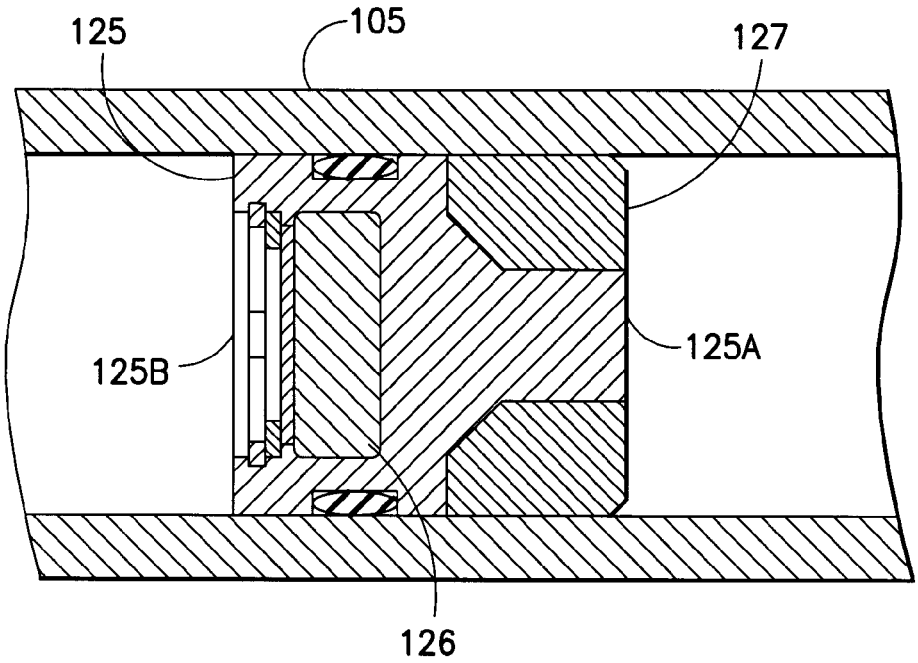
FIG. 10 shows an optional piston having a magnet as well as additional sealing devices within the chamber, according to embodiments of the disclosed subject matter.

FIG. 10 shows an optional piston (125) having a magnet (126) as well as additional sealing devices (127) within the chamber (105). Further, the piston (125) has a bottom (125A) position toward the first end of the chamber and a top (125B) position toward the second end of the chamber.

Figure 11:
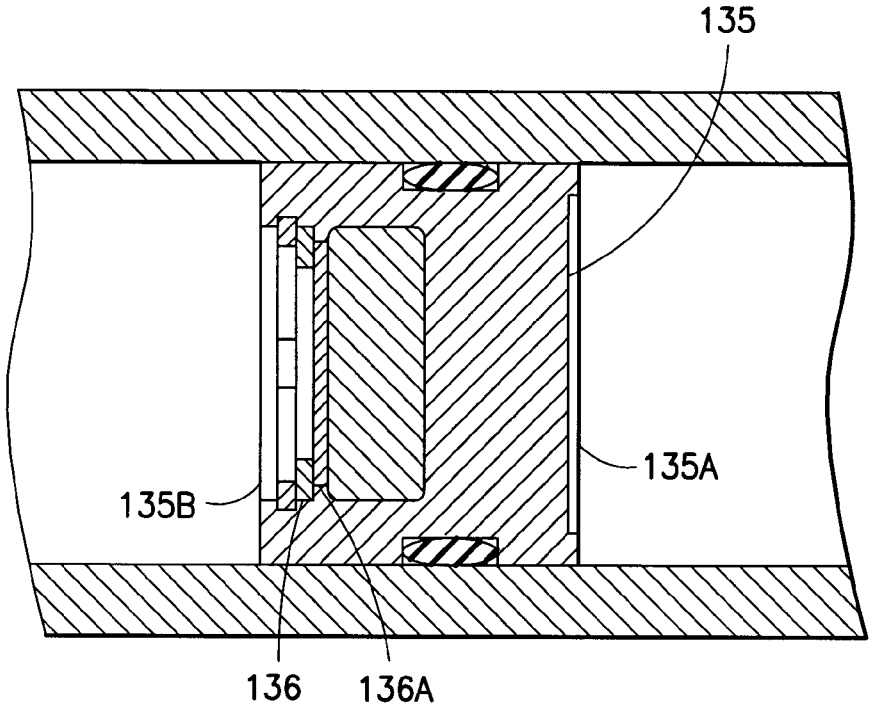
FIG. 11 shows an optional piston having a magnet with a magnet holder within the chamber, according to embodiments of the disclosed subject matter.
Figures 12A, 12B, 12C, 12D, 12E, 12F, 12G, 12H:
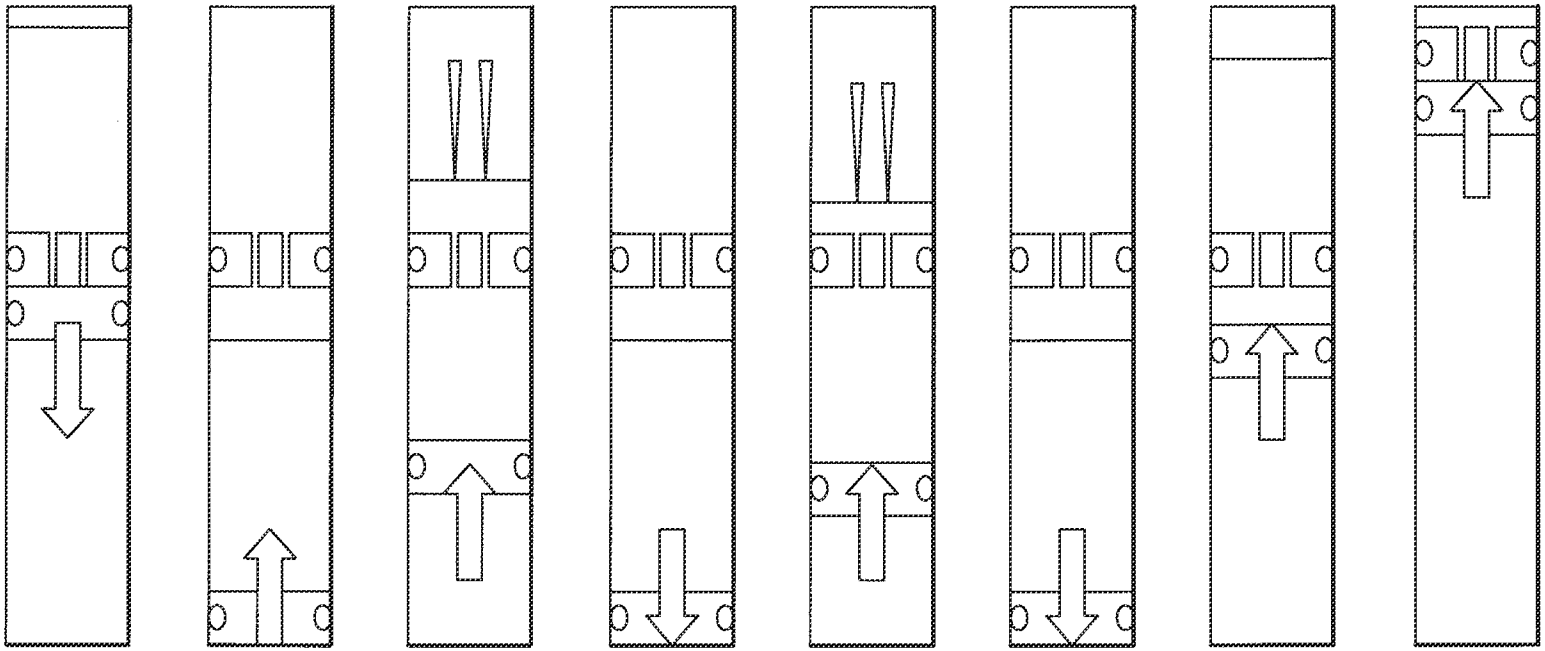
FIGS. 12A to 12H illustrate sequenced steps of at least one method, according to embodiments of the disclosed subject matter in the application.
Figure 13A:
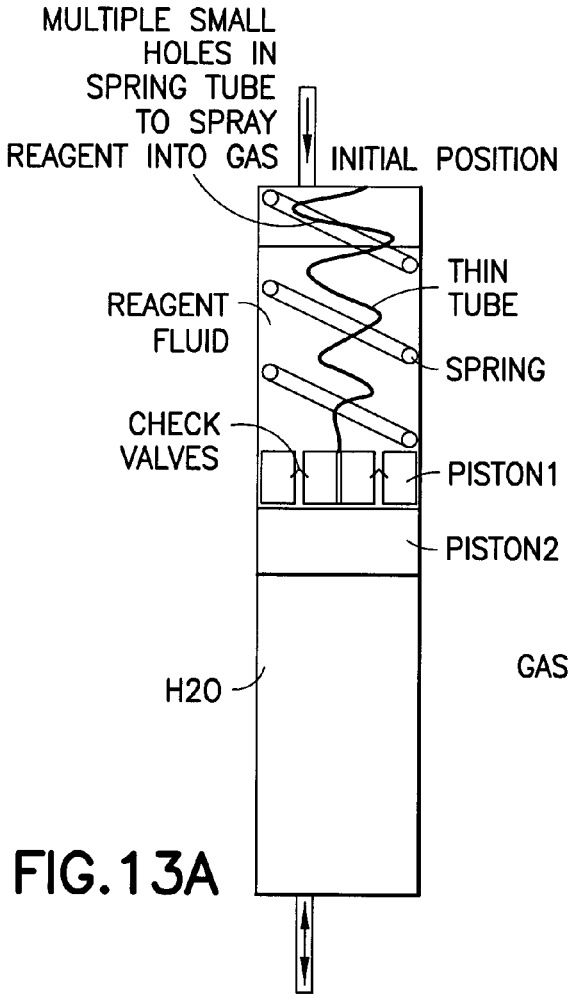
FIGS. 13A to 13D illustrate sequenced steps of at least one method, according to embodiments of the disclosed subject matter in the application.
Figure 13B:
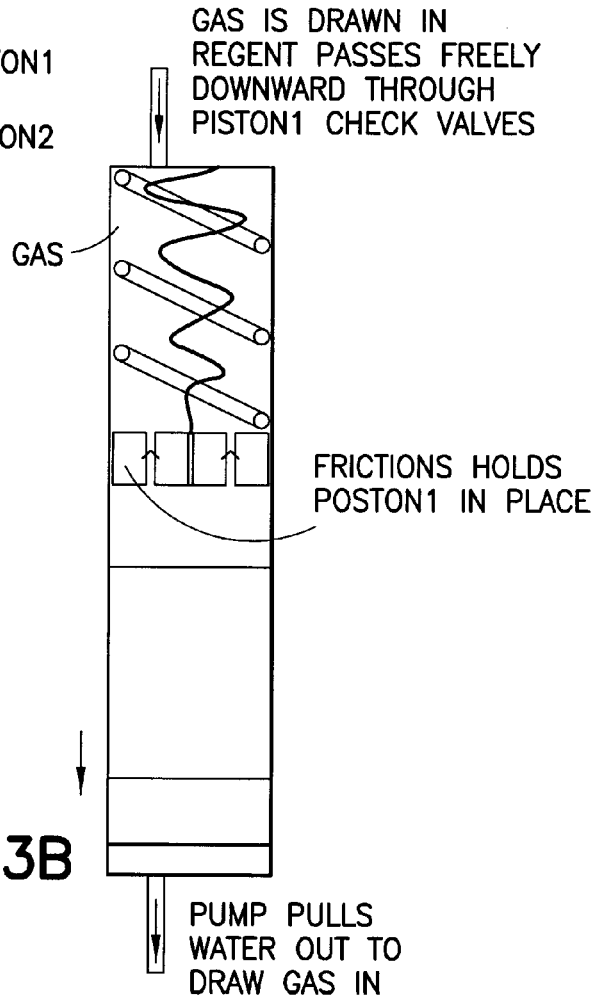
Figure 13C:
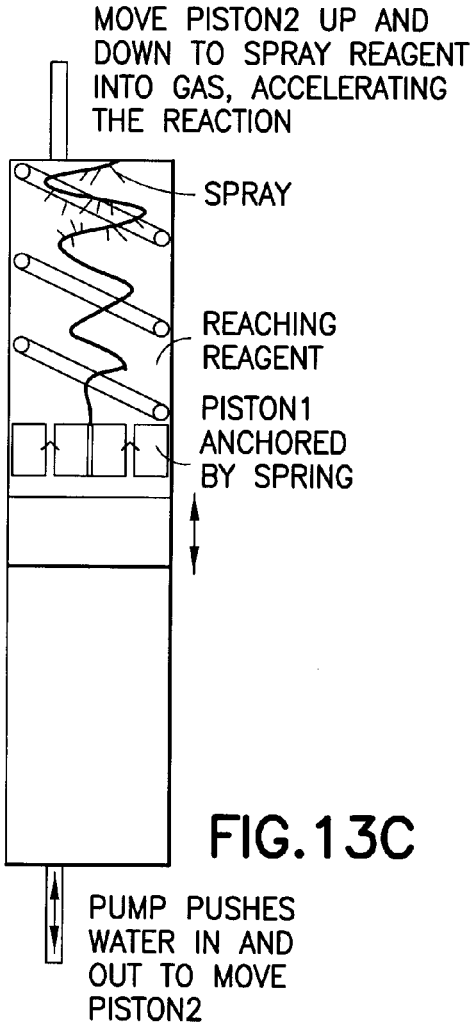
Figure 13D:
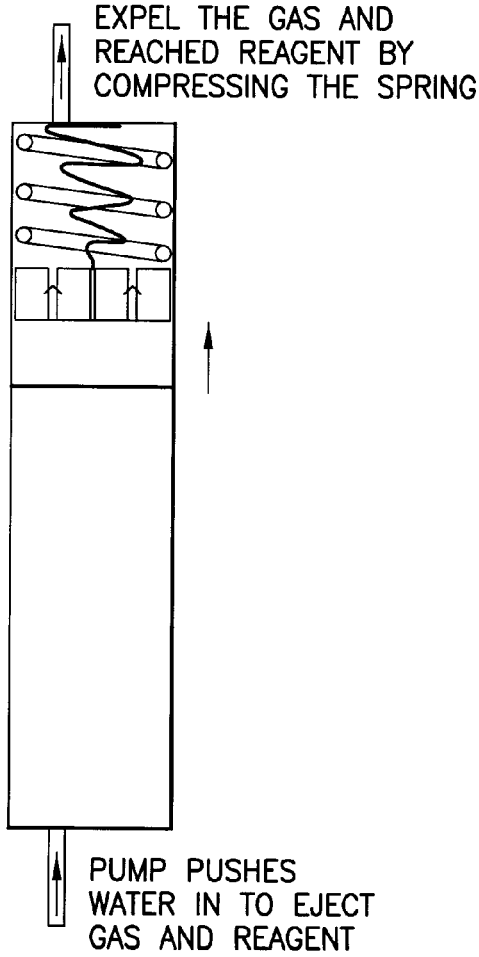

FIG. 11 shows an optional piston (135) having a magnet (136) with a magnet holder (136A) within the chamber (105). Further, the piston (135) has a bottom (135A) position toward the first end of the chamber and a top (135B) position toward the second end of the chamber.

FIGS. 12A to 12H illustrate at least one method according to the subject matter disclosed in the application. The downhole method includes mixing a first fluid with a pressurized second fluid by forming fluid droplets by spraying a pressurized fluid mixture. The method includes the steps of: (a) positioning a perforated piston having a top surface and a bottom surface within a chamber, wherein the perforated piston is located at a first position within the chamber based upon characteristics of a second fluid, the chamber having a first end, a second end and at least one opening; (b) introducing the first fluid into the chamber, wherein the perforated piston has one or more channel for fluid to flow there through; (c) introducing the pressurized second fluid into the chamber, the pressurized second fluid partially mixes with the first fluid, the fluid mixture flows through the one or more channel from the top surface and exits the bottom surface of the perforated piston to move at least one piston to approximately the first end of the chamber, and closing the at least one opening; (d) actuating a bottom surface of the at least one piston with an actuating device to move the at least one piston from the first end toward the second end of the chamber to inject the fluid mixture through the one or more channel from the bottom surface through to the top surface of the perforated piston to produce spray droplets; (e) actuating the bottom surface of the at least one piston with the actuating device to move the at least one piston from the second end to the first end of the chamber; (f) repeating steps (d) and (e) one or more times; and finally (g) opening the at least one opening, actuating the bottom surface of the at least one piston with the actuating device to move the at least one piston from the first end to the second end of the chamber to exit the fluid mixture out of the chamber, wherein the top surface of the at least one piston contacts the bottom surface of the perforated piston and the top surface of the perforated piston contacts the second end of the chamber. It is noted that measurements may be taken after step (c) to determine a volume of the second fluid sample. Also, as noted above, the chamber may be coated with a material to provide for further manipulation of fluids containing $H_2S$. It is possible the top surface of the at least one piston can be capable of contacting the bottom surface of the perforated piston. Further still, regarding step (d) the reservoir fluid can be compressible which can assist in the operation of the device.

FIGS. 13A-13D illustrate at least one method according to the subject matter disclosed in the application. The downhole method includes mixing a first fluid with a pressurized second fluid by forming fluid droplets by spraying a pressurized fluid mixture. The mixing of the fluids is assisted, in part, by the partial movement of at least one piston by an actuating device or system, in combination with at least one perforated piston, wherein the at least one piston and the at least one perforated piston are housed within a chamber.

Still referring to FIGS. 13A-13D, the method includes the steps of: (a) positioning a perforated piston having a top surface and a bottom surface within a chamber, wherein the perforated piston is located at a first position within the chamber based upon characteristics of a second fluid, the chamber having a first end, a second end and at least two openings, wherein a spring device is positioned within the chamber having at least one end approximate the top surface of the perforated piston and another end approximate the second end of the chamber, the spring device is in a non-compressed state; (b) introducing the first fluid into the chamber, wherein the perforated piston has one or more channel for fluid to flow there through; (c) introducing the pressurized second fluid into the chamber, the pressurized second fluid partially mixes with the first fluid, the fluid mixture flows through the one or more channel from the top surface and exits the bottom surface of the perforated piston to move at least one piston to approximately the first end of the chamber; (d) actuating a bottom surface of the at least one piston with an actuating device to move the at least one piston from the first end toward the second end of the chamber to inject the fluid mixture through the one or more channel from the bottom surface through to the top surface of the perforated piston to produce spray droplets: wherein at least one perforated thin spring-like tubing is in communication with the one or more channel at the top surface of the perforated piston and extends toward the second end of the chamber to further assist in producing spray droplets; (e) actuating the bottom surface of the at least one piston with the actuating device to move the at least one piston from the second end to the first end of the chamber; (f) repeating steps (d) and (e) one or more times; and finally (g) opening the at least one opening, actuating the bottom surface of the at least one piston with the actuating device to move the at least one piston from the first end to the second end of the chamber to exit the fluid mixture out of the chamber and to compress the spring device, wherein the top surface of the at least one piston contacts the bottom surface of the perforated piston and the top surface of the perforated piston almost contacts the second end of the chamber. It is noted that measurements may be taken after step (c) to determine a volume of the second fluid sample. As noted above, the chamber may be coated with a material, to provide for manipulation of fluids containing $H_2S$. It is noted that the top surface of the at least one piston is capable of contacting the bottom surface of the perforated piston. It is noted regarding step (d) that the reservoir fluid is compressible which can assist in the operation of the device. Further, the spring device can be an elastic object used to store mechanical energy or any device that provides for an actuating action. Further, the spring can be used to keep in place the perforated piston and used either by itself or in combination with the at least one perforated thin spring-like tubing. The spring device may be integral to the chamber or a separate device inserted into the chamber. It is possible the shape of the one or more channels may be other than straight. Further still, the one or more channels may include check valve devices. Further, while the present disclosed subject matter has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present disclosed subject matter in its aspects. Although the present disclosed subject matter has been described herein with reference to particular means, materials and embodiments, the present disclosed subject matter is not intended to be limited to the particulars disclosed herein; rather, the present disclosed subject matter extends to all functionally equivalent structures, methods and uses, such as are within the scope of the appended claims.

What is claimed is:

1. A downhole tool comprising:

an inlet for engaging a formation in a subterranean environment and withdrawing formation fluid from the formation and into the downhole tool;

an apparatus for mixing a first fluid with the formation fluid, the apparatus comprising:

a chamber having a first end, a second end, and at least one opening, wherein the at least one opening allows fluid to flow into the chamber;

a perforated piston positioned within the chamber, wherein the perforated piston comprises a bottom surface, a top surface, and one or more channels that allow fluid to flow between the top surface and the bottom surface of the perforated piston; and at least one movable piston positioned within the chamber, wherein the movable piston generates a seal between the first end and the second end of the chamber and is movable along the chamber towards the first end and towards the second end of the chamber.

2. The downhole tool of claim 1, wherein the one or more channels of the perforated piston are linear.

3. The downhole tool of claim 2, wherein the one or more channels of the perforated piston comprise two or more channels.

4. The downhole tool of claim 3, wherein at least one channel of the two or more channels includes (i) an outlet on the top surface of the perforated piston comprising an outlet diameter and (ii) an inlet on the bottom surface of the perforated piston comprising an inlet diameter that is greater than the outlet diameter.

5. The downhole tool of claim 1, wherein the downhole mixing apparatus is used for at least one of gas scrubbing, a colorimetric sensing measurement, a electrochemical sensing measurement, and a magnetic resonance sensing measurement.

6. The downhole tool of claim 1, wherein the movable piston comprises at least one magnet to identify a location of the movable piston within the chamber.

7. The downhole tool of claim 1, wherein the perforated piston comprises a sealing device and the movable piston comprises a sealing device.

8. The downhole tool of claim 1, wherein a top surface of the movable piston symmetrically forms to the bottom surface of the perforated piston.

9. The downhole tool of claim 8, wherein the top surface of the movable piston is linear.

10. The downhole tool of claim 1, wherein the top surface of the perforated piston symmetrically forms to the second end of the chamber.

11. The downhole tool of claim 10, wherein the top surface of the perforated piston is linear.

12. The downhole tool of claim 1, wherein at least one of the chamber, the movable piston, and the perforated piston include one or more coatings.

13. The downhole tool of claim 1, wherein at least one channel of the one or more channels has a diameter in a range between 10 microns to 5 centimeters.

14. The downhole tool of claim 13, wherein at least one channel of the one or more channels has a diameter in a range between 0.2 millimeters to 1 millimeter.

15. The downhole tool of claim 1, wherein the top surface of the perforated piston includes at least one nozzle.

16. The downhole tool of claim 1, wherein the perforated piston includes at least one moveable insert within the one or more channels and the moveable insert is capable of extending above the top surface of the perforated piston.

17. The downhole tool of claim 1, wherein at least one spring device is positioned between the top surface of the perforated piston and the second end of the chamber.

18. The downhole tool of claim 1, further comprising:

at least one fluid delivery system configured to supply a volume of the formation fluid to the chamber through the at least one opening so that at least a portion of the first fluid passes through the one or more channels in the perforated piston; and an actuating device configured to move the movable piston towards the perforated piston and the second end of the chamber to inject at least a portion of the first fluid through the one or more channels of the perforated piston and into the formation fluid.

19. The downhole tool of claim 18, wherein the formation fluid is compressible.

20. The downhole tool of claim 18, wherein the volume of the first fluid within the chamber is configured so that at least 25% of the first fluid is injected through the perforated piston when the movable piston is moved toward the perforated piston.

21. The downhole tool of claim 18, wherein the first fluid is a reactant fluid selected to detect at least one of $H_2S$, $CO_2$, and Hg within the formation fluid.

22. The downhole tool of claim 18, wherein the formation fluid comprises a gas, a liquid, or some combination thereof.

23. The downhole tool of claim 18, wherein the first fluid forms a spray of droplets as the first fluid is injected into the formation fluid.

24. The downhole tool of claim 23, wherein the spray of droplets increases a surface to volume ratio of the first fluid to significantly increase reaction or mixing with the formation fluid.

25. The downhole tool of claim 18, wherein the actuating device is further configured to move the movable piston towards the first end of the chamber.

26. The downhole tool of claim 18, wherein a length and a radius of the one or more channels are configured so that a force generated by the injection of first fluid through the one or more channels is less than a static friction force that maintains the perforated piston stationary inside the chamber.

27. A downhole method for mixing a first fluid with a formation fluid within a chamber that comprises a first end, a second end, a perforated piston, at least one movable piston, and at least one opening, the method comprising:

(a) introducing the formation fluid into the chamber through the at least one opening so that at least a portion of the first fluid passes through one or more channels in the perforated piston;

(b) moving the movable piston towards the perforated piston and the second end of the chamber to inject at least a portion of the first fluid through the one or more channels of the perforated piston and into the formation fluid;

(c) moving the movable piston away from the perforated piston and towards the first end of the chamber; and (d) repeating steps (b) and (c) one or more times to form a mixture between the first fluid and the formation fluid.

28. The downhole method of claim 27, wherein the perforated piston remains stationary during step (a) through to step (d).

29. The downhole method of claim 27, wherein the formation fluid is compressible.

30. The downhole method of claim 27, wherein a volume of the first fluid in the chamber is configured so that at least 25% of the first fluid is injected through the perforated piston when the movable piston is moved toward the perforated piston.

31. The downhole method of claim 27, wherein the first fluid is a reagent fluid.

32. The downhole method of claim 27, wherein, at step (b), a spray of droplets is formed when the first fluid is injected into the formation fluid.

33. The downhole method of claim 27, wherein the formation fluid comprises a gas, a liquid, or some combination thereof.

34. The downhole method of claim 27, wherein the one or more channels of the perforated piston are linear.

35. The downhole method of claim 27, wherein the one or more channels comprise two or more channels.

36. The downhole method of claim 35, wherein at least one channel of the two or more channels includes (i) an outlet on a top surface of the perforated piston comprising an outlet diameter and (ii) an inlet on a bottom surface of the perforated piston comprising an inlet diameter that is greater than the outlet diameter.

37. The downhole method of claim 27, wherein the chamber is part of a downhole tool and the downhole tool comprises an inlet for engaging a formation in the subterranean environment and withdrawing the formation fluid from the formation and into the downhole tool.

38. The downhole method of claim 27, wherein the perforated piston comprises a sealing device and the movable piston comprises a sealing device.

39. The downhole method of claim 27, wherein the chamber, the movable piston, or the perforated piston are coated with one or more coatings.

40. The downhole method of claim 27, wherein a top surface of the movable piston is configured to symmetrically form to a bottom surface of the perforated piston.

41. The downhole method of claim 40, wherein the top surface of the movable piston is configured to be linear.

42. The downhole method of claim 27, wherein a top surface of the perforated piston is configured to symmetrically form to the second end of the chamber.

43. The downhole method of claim 42, wherein the top surface of the perforated piston is linear.

44. The downhole method of claim 27, wherein a radius and length of the one or more channels are configured so that a force generated by the injection of first fluid through the one or more channels is less than a static friction force that maintains the perforated piston stationary inside the chamber.

45. The downhole method of claim 27, further comprising:

(e) moving the movable piston and the perforated piston toward the second end of the chamber so that the fluid mixture exits the chamber through the at least one opening.

46. The downhole method of claim 45, wherein the chamber is part of a downhole tool and the method further comprises analyzing the mixture within the downhole tool after the mixture exits the chamber.

47. The downhole method of claim 45, wherein the mixture exiting the chamber is a homogenous fluid.

48. The downhole method of claim 27, further comprising:

(f) introducing the first fluid into the chamber before the formation fluid is introduced into the chamber in step (a).

* * * * *